US006882332B2

(12) United States Patent
Zeiter et al.

(10) Patent No.: US 6,882,332 B2
(45) Date of Patent: Apr. 19, 2005

(54) DISPLAY DEVICE WITH ADAPTIVE SELECTION OF THE NUMBER OF SIMULTANEOUSLY DISPLAYED ROWS

(75) Inventors: Dominik Zeiter, Schlieren (CH); Anthonius Franciscus Duisters, Zurich (CH)

(73) Assignee: Koninklijke Philips Electronics N.V., Eindhoven (NL)

( * ) Notice: Subject to any disclaimer, the term of this patent is extended or adjusted under 35 U.S.C. 154(b) by 319 days.

(21) Appl. No.: 09/998,055

(22) Filed: Nov. 29, 2001

(65) Prior Publication Data

US 2002/0135551 A1 Sep. 26, 2002

(30) Foreign Application Priority Data

Nov. 30, 2000 (DE) ..... 100 59 768

(51) Int. Cl.[7] ..... G09G 3/36

(52) U.S. Cl. ..... 345/87; 345/50; 345/55; 345/88; 345/99; 345/100

(58) Field of Search ..... 345/50, 55, 87–88, 345/99–100, 89, 82, 94, 95–96, 98, 204–206, 209–210, 213–214, 692–693, 696, 699

(56) References Cited

U.S. PATENT DOCUMENTS

| | | | | |
|---|---|---|---|---|
| 5,710,576 A | * | 1/1998 | Nishiyama et al. | 345/169 |
| 5,760,757 A | * | 6/1998 | Tanaka et al. | 345/93 |
| 5,859,625 A | * | 1/1999 | Hartung et al. | 345/95 |
| 6,256,025 B1 | * | 7/2001 | Imai et al. | 345/211 |
| 6,317,108 B1 | * | 11/2001 | Kalt | 345/85 |
| 6,323,849 B1 | * | 11/2001 | He et al. | 345/204 |
| 6,346,774 B1 | * | 2/2002 | Tamai et al. | 315/169.1 |
| 6,369,791 B1 | * | 4/2002 | Kudo et al. | 345/100 |
| 6,426,594 B1 | * | 7/2002 | Ito | 315/169.1 |

FOREIGN PATENT DOCUMENTS

| | | | |
|---|---|---|---|
| EP | 0811866 A1 | 12/1997 | G02F/1/133 |
| JP | 281632 A | 2/1996 | G09G/3/18 |

OTHER PUBLICATIONS

T.N. Ruckmongathan, "Some New Addressing Techniques for RMS Responding Matrix LCDS", Feb. 1988, PHD Thesis, Indian Institute of Science, Bangalore, pp. vi, vii, 3.3–3.51, 4.1–4.14, 4.36–4.51, XP002240917.

* cited by examiner

*Primary Examiner*—Vijay Shankar
*Assistant Examiner*—Leonid Shapiro
(74) *Attorney, Agent, or Firm*—Kevin Simons

(57) ABSTRACT

The invention relates to a display device which includes a driver circuit and a liquid crystal display with a plurality of rows R and columns C. The invention also relates to a driver circuit for driving a display. In order to reduce the power consumption of display devices, displays are operated in the partial display mode. According to the MRA (Multiple Row Addressing) technique a plurality of rows p is driven simultaneously. The number of rows p to be simultaneously driven, however, differs for displays of different size. When a display is operated in the partial display mode, therefore, for an optimum optical performance it is necessary that the value p of the rows to be simultaneously driven is other than this number in full size operation. In order to drive the rows R and columns C, at least p+1 voltages are required when $F=G_{MAX}$. Because the number of simultaneously driven rows is reduced upon a transition from the full size mode of operation to the partial display mode, it is also no longer necessary to generate as many voltages as would be required for operation in the full size mode. Therefore, upon transition to the partial display mode the voltage driver stages that are no longer required are switched off by way of a switching device. As a result, displays of different size can also be driven by means of one driver circuit.

6 Claims, 4 Drawing Sheets

DISPLAY DEVICE WITH ADAPTIVE SELECTION OF THE NUMBER OF SIMULTANEOUSLY DISPLAYED ROWS

BACKGROUND OF INVENTION

1. Field of the Invention

The invention relates to a display device which includes a driver circuit and a liquid crystal display with a plurality of rows R and columns C. The invention also relates to a driver circuit for driving a display.

2. Description of Related Art

The display technique will play an increasingly more important role in the information and communication technique in the years to come. Being an interface between humans and the digital world, the display device is of crucial importance for the acceptance of contemporary information systems. Notably portable apparatus such as. for example, notebooks, telephones, digital cameras and personal digital assistants cannot be realized without utilizing displays. The passive matrix LCD technology is a very commonly used LCD technology; it is used, for example, in laptops and in mobile telephones. The passive matrix display technology enables the implementation of large displays; such large displays are usually based on the (S)TN (Super Twisted Nematic) effect. A passive matrix LCD consists of a number of layers. The display is subdivided in the form of a matrix of rows and columns. The row electrodes and column electrodes that are arranged on respective substrates form a grid. The layer with the liquid crystal is provided between said substrates. The intersections of these electrodes, form image points or pixels. These electrodes are supplied with voltages that orient the liquid crystal molecules of the driven pixels in an appropriate direction so that the driven pixel becomes visible.

Since the size of the displays becomes larger, the significance of the power consumption of the passive matrix LCD displays for mobile applications increases all the time. Because such passive matrix displays are often used in portable apparatus, it is particularly important to realize a low power consumption. The effective deployment of a standby mode is a suitable approach to reducing the power consumption. For example, in mobile telephones all components that are not necessary are deactivated in such a standby mode. The display is then also switched to a partial display mode.

In addition to the power consumption, however, the optical performance of such STN LC displays is also a decisive criterion for the selection of display devices of this kind. For this type of STN LC display it is known to use an addressing technique where a plurality of rows is simultaneously driven and the encoded image information is applied to the columns. This MRA (Multiple Row Addressing) technique enables a very good optical performance to be achieved in combination with a low power consumption.

According to said MRA technique a number of p rows is simultaneously driven. A set of orthogonal functions is then applied to the simultaneously driven rows p. A function for driving the corresponding column is calculated from said set of orthogonal functions by way of a calculation rule. Using this function for driving the column, a voltage is selected from a plurality of partial voltage values, said voltage being applied to the corresponding column so that the corresponding pixels or image points are switched to an initial or starting state, that is, in dependence on the data that is supplied from a memory.

Not the entire display is driven in the partial display mode; this means that only sub-regions of the display are required for the display of information. In the case of addressing by means of the MRA technique, however, it is necessary to select an optimum value p of the number of simultaneously driven rows so as to achieve the best optical performance.

p+1 different voltages are required so as to drive p simultaneously driven rows. These voltages are generated by means of a plurality of voltage driver stages in a driver circuit for driving the display. The driver circuit is configured in such a manner that said driver circuits drive the maximum possible number p of rows that are to be simultaneously driven and also comprise a corresponding number of voltage driver stages.

Using such driver circuits it is not possible to influence the circuit in the partial display mode in such a manner that the saving of power is optimized. Moreover, such a driver circuit is capable of driving only a limited number of different display sizes.

Therefore, it is an object of the invention to provide a display device whereby the number p of rows of a display that are to be simultaneously driven can be adaptively selected with a reduced power consumption and for different display sizes.

BRIEF SUMMARY OF THE INVENTION

This object is achieved in accordance with the invention in that a display device which includes a driver circuit (1) and a display (2) with a plurality of rows R and columns C, where a number p indicates the number of simultaneously driven rows, where the rows R and the columns C can be driven by means of voltage values of the equally high voltages F and $G_{MAX}$, and where the display has a multiplexibility of m $\geqq$R and the number p of simultaneously driven rows can be selected in dependence on the display size to be driven, whereas the driver circuit (1) includes voltage driver stages (buffers) that can be switched off in dependence on the optimal number p to be simultaneously driven, which is derived from the display size.

The invention is based on the idea that in the partial display mode the optimum number p of simultaneously driven rows usually is lower than when the full display is driven. Because p+1 different partial voltage values are always required when the MRA addressing technique is used, including the two voltage levels $V_{LCD}$ and $V_{SS}$, therefore, fewer different partial voltage values are also required in the partial display mode.

In order to achieve the most attractive optimum performance in the case of this MRA addressing technique, the selection of the number p of simultaneously selected rows must be optimum. For example, for an LCD display with 64 or more rows, a number of p of eight simultaneously driven rows must be selected in order to achieve the best optical performance and a lower LCD supply voltage at the same time.

A first step for reducing the complexity of the driver circuit while reducing the power consumption of the LCD driver circuit at the same time is to use equal maximum voltages for driving the columns and the rows. When the row voltages F, −F and the highest and lowest column voltages $G_{MAX}$, $-G_{MAX}$ are chosen to be equal, only p−1 partial voltages will be required. As a result, fewer partial voltage values will have to be generated for the LCD display and at the same time the complexity and the power consumption of the LCD driver will be reduced, because it is no longer necessary to drive all voltage driver stages present.

However, a partial display mode cannot be realized by means of equally high maximum column and row voltages only.

LCD liquids have a property that is referred to as the multiplexibility m. This property indicates how many rows can be driven at the most. The multiplexibility m is selected to be such that it is at least as large as required by the maximum number of rows of the display that can be driven. For the choice of p there is thus obtained a further degree of freedom that enables F and $G_{MAX}$ to be set to the same voltage level for different display sizes in a partial display mode. In order to achieve this, p and m can be varied.

In accordance with the invention it is proposed to form the number p of simultaneously driven rows in an adaptive manner. This enables the LCD drivers to be used for many different applications. A partial display mode can thus be realized while reducing at the same time the complexity of the driver as well as the power consumption. Using a switching device, in such a case the voltage driver stages that are required for generating the individual partial voltage values are switched on only if necessary. The power consumption is thus reduced in general and in the partial display mode in particular. In dependence on a mode of operation of the apparatus in which the display is used, a processor generates a signal whereby the display is switched to the partial display mode. On the basis of the display size and the mode of operation the number p is then calculated or fixed so as to minimize the power consumption. This number p is used to control the switching device. The switching device switches off the voltage driver stages that are no longer necessary, so that they do not consume power. In the case of a partial display mode with 32 rows where, for example, only two rows are simultaneously driven, only three voltage values are then required still, two of said voltages being the two supply voltages and the other voltage being a partial voltage.

BRIEF DESCRIPTION OF THE DRAWINGS

The invention will be described in detail hereinafter with reference to the embodiments that are shown in the drawings. Therein.

DETAILED DESCRIPTION

Figure 1:
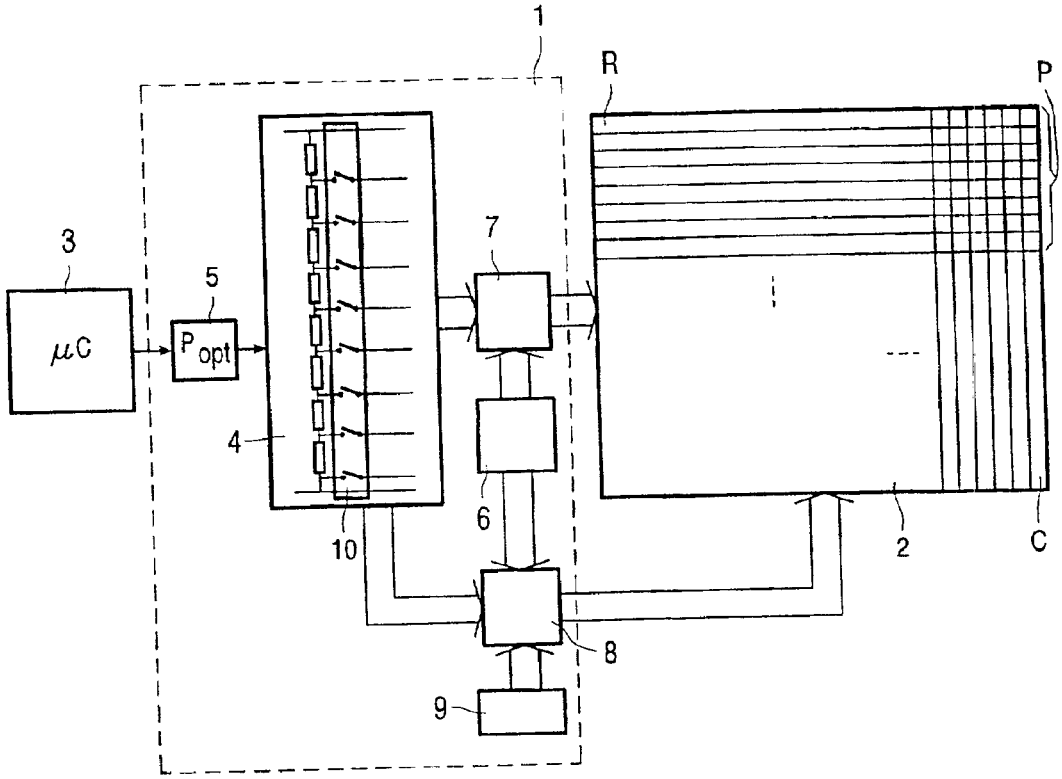
FIG. 1 shows a circuit diagram of the display device in accordance with the invention.

FIG. 1 shows the driver circuit 1, the display 2 and the microcontroller 3. The driver circuit 1 includes a memory 9 in which the image data is stored. The driver circuit 1 also includes a voltage generating unit 4. The optimum value for the number p is calculated in an arithmetic unit 5. The switching device 10 of the voltage generating unit 4 is controlled by means of said optimum value p. The partial voltages that are generaied in the voltage generating unit 4 and the two supply voltages are applied to a switch 7. A function generator 6 generates sets of orthogonal functions that are applied to the rows in dependence on the value p. These sets of orthogonal functions are also applied to said switch 7. The partial voltages presented and the orthogonal functions are combined therein so as to be applied each time as a set of orthogonal functions to the p rows to be simultaneously driven. The p−1 partial voltage values and the two supply voltages $V_{LCD}$ and $V_{SS}$ are also applied to the switch 8. The set of orthogonal functions that is generated by the function generator 6 is also applied to the switch 8. In the switch 8 the column voltage G is calculated in conformity with the MRA theory, that is, by means of the set of orthogonal functions, the value p and image data that is read from the memory 9 and corresponds to the p driven rows of a column. This column voltage is selected from the number of partial voltages.

The microcontroller 3 may be integrated, for example, in a mobile telephone. Depending on the operating state of this apparatus, the display mode is defined in which the display must be driven. If only partial display is necessary in the standby mode, the corresponding p value that offers the best optical performance is selected by means of a look-up table that is stored in a memory (not shown). Using this p value, the individual voltage driver stages in the voltage generating unit 4 are switched on as necessary. This makes it possible to generate only five different partial voltage values in a case where four rows have to be driven simultaneously, so that the power consumption for driving a display is less than when five partial voltages would be used for p=4 and nevertheless nine partial voltages would be generated or made available.

Table 1 shows the necessary supply voltages for the display for different partial display modes and multiplexibilities m of the display. Therein, F[V] is the voltage whereby the rows of the display are driven and $G_{MAX}$[V] is the maximum voltage whereby the columns of the display are driven. Both voltages can tend towards positive as well as negative values, so that an overall supply voltage $V_{LCD}$ [V] that corresponds to double the value of F and $G_{MAX}$ is required for the display.

TABLE 1 required $V_{LCD}$ for a $V_{TH}$ = 1.8 V for partial display mode with adaptive p value.

| Display Size | N | m | p | F[V] | $G_{max}$[V] | $V_{LCD}$[V] |
|---|---|---|---|---|---|---|
| 16 | 16 | 25 | 2 | 2.55 | 2.55 | 5.1 |
| 24 | 24 | 49 | 2 | 2.55 | 2.55 | 5.1 |
| 32 | 32 | 81 | 2 | 2.55 | 2.55 | 5.1 |
| 40 | 40 | 49 | 4 | 3.29 | 3.29 | 6.58 |
| 48 | 48 | 64 | 4 | 3.33 | 3.33 | 6.66 |
| 56 | 56 | 81 | 4 | 3.38 | 3.38 | 6.76 |
| 64 | 64 | 64 | 8 | 3.85 | 3.85 | 6.70 |
| 80 | 80 | 81 | 8 | 4.02 | 4.02 | 8.04 |

Figure 2:
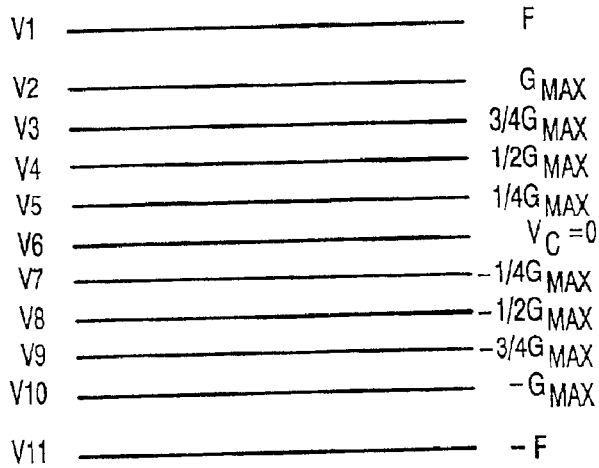
FIG. 2 shows partial voltage values for an MRA LCD driver with p=8.

FIG. 2 shows the partial voltage levels for an MRA system with eight simultaneously selected rows. The row voltage and the maximum column voltage are represented therein as different values. Consequently, in that case 11 different voltages are required for p=8 and $F \neq G_{MAX}$. The row voltage (−F, $V_C$, F) and the column voltages ($-G_{MAX}$ . . . $V_C$ . . . $G_{MAX}$) are equidistantly arranged around the level $V_C$. Generally speaking, p+1 different voltage values are required for driving the columns. The row voltages F and the maximum column voltage $G_{MAX}$ can be calculated by means of the formulae 3 and 4. The voltages Vd and Vs therein are variables from the Alt & Pleshko method (Alt & Pleshko "Scanning limitations of liquid crystal displays", IEEE Trans. El. Dev., Vol. Ed21, No. 2, February 1974, pp. 146–155) and are calculated by means of the following formulae (1) and (2).

$$V_S = V_{TH} \cdot \sqrt{\frac{N}{2} \cdot \frac{\sqrt{m} \pm \sqrt{m-N}}{\sqrt{m}-1}} \tag{1}$$

$$Vd = V_{TH} \cdot \sqrt{\frac{N}{2 \cdot (\sqrt{m}-1) \cdot (\sqrt{m} \pm \sqrt{m-N})}} \tag{2}$$

$$F = \frac{V_S}{\sqrt{p}} \tag{3}$$

$$G_{MAX} = \sqrt{p} \cdot V_D \tag{4}$$

Figure 3:
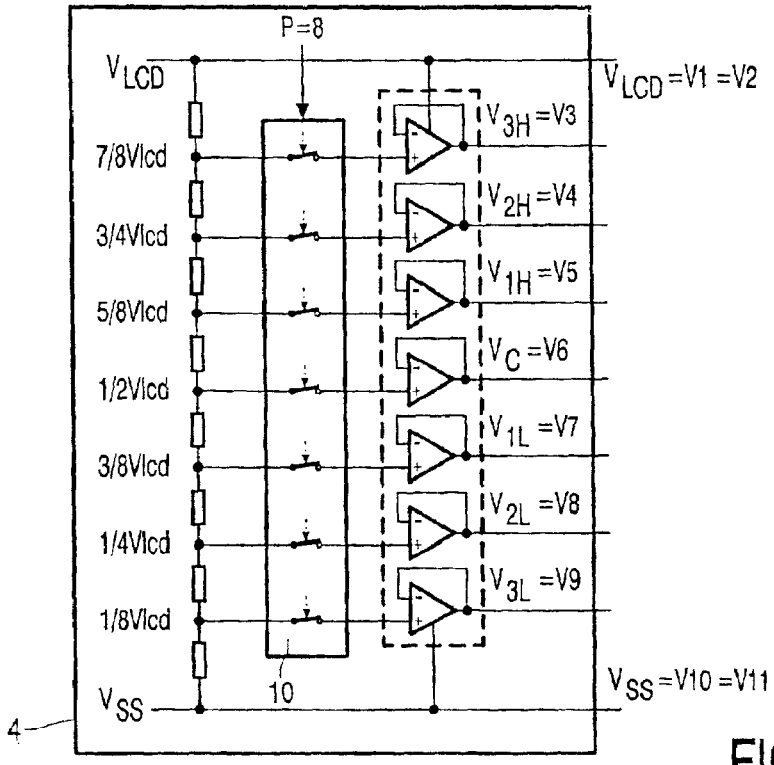
FIG. 3 shows the generating of partial voltages for an LCD driver with p=8.

In order to reduce the number of different voltage values required, the row voltages F and the maximum column voltage $G_{MAX}$ are chosen so as to be equal. FIG. 3 shows the voltage generating unit 4 for the case where eight rows are simultaneously driven. Therein, the row voltage F and the maximum column voltage $G_{MAX}$ are chosen so as to be equal, so that $V_1=V_2=V_{LCD}$ and $V_{10}=V_{11}=V_{SS}$, with the result that only nine different voltage levels are required; it is not necessary to generate $V_{LCD}$ and $V_{SS}$ additionally, but they are required for the general power supply of the driver circuit. Because the maximum column voltage is not necessarily lower than the row voltage, the equalization of the maximum column voltage $G_{MAX}$ and the row voltage F and −F results in a reduction of the complexity of the voltage generating unit. The switching device 10 controls the switching off of the voltage driver stages $V_3$ to $V_9$ in dependence on the optimum value p. In the case p=8, all seven feasible partial voltages are generated by means of the voltage driver stages.

Figure 4:
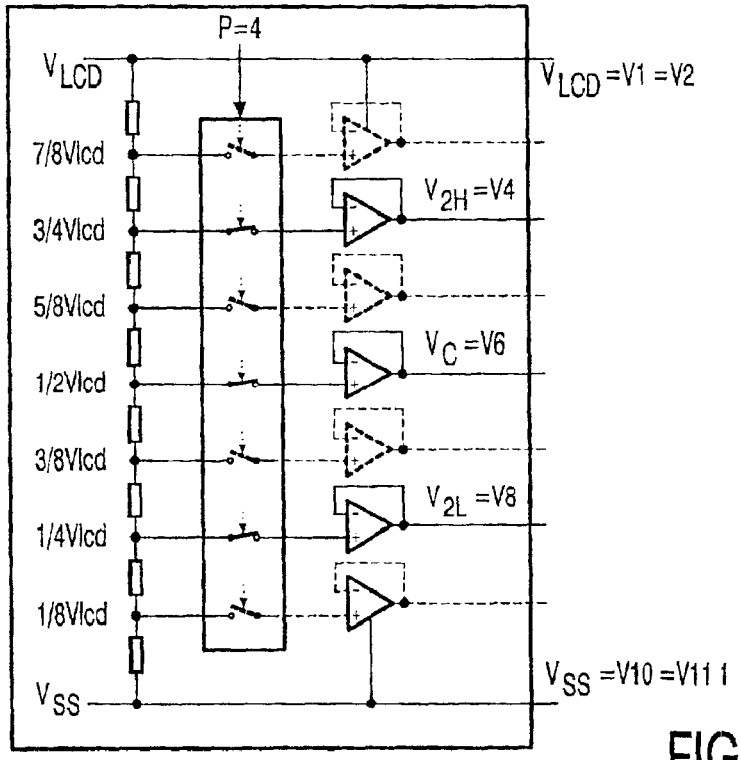
FIG. 4 shows the generating of partial voltages for p=4.

FIG. 4 illustrates the generating of five voltage values $V_{LCD}$, $V_4$, $V_6$, $V_8$ and $V_{SS}$ for the case where the number p of simultaneously driven rows equals four. The switched off voltage driver stages $V_3$, $V_5$, $V_7$, $V_9$ are shown in dashed lines; the switching means in the switching device 10 are open for the corresponding voltage driver stages that are not required.

Table 2 shows the partial voltage values for different values p that are applied to the display.

TABLE 2

Partial voltage values for different p values.

| Bias Level | p = 8 | p = 4 | p = 2 | |
|---|---|---|---|---|
| V1 | $V_{LCD}$ | $V_{LCD}$ | $V_{LCD}$ | Rows |
| V2 | $V_{LCD}$ | $V_{LCD}$ | $V_{LCD}$ | Columns |
| V3 | ⅞ $V_{LCD}$ | — | — | Columns |
| V4 | ¾ $V_{LCD}$ | ¾ $V_{LCD}$ | — | Columns |
| V5 | ⅝ $V_{LCD}$ | — | — | Columns |
| V6 | ½ $V_{LCD}$ | ½ $V_{LCD}$ | ½ $V_{LCD}$ | Rows and columns |
| V7 | ⅜ $V_{LCD}$ | — | — | Columns |
| V8 | ¼ $V_{LCD}$ | ¼ $V_{LCD}$ | — | Columns |
| V9 | ⅛ $V_{LCD}$ | — | — | Columns |
| V10 | $V_{ss}$ | $V_{ss}$ | $V_{ss}$ | Columns |
| V11 | $V_{ss}$ | $V_{ss}$ | $V_{ss}$ | Rows |

It appears that for p values that are smaller than eight, the corresponding voltage drivers are switched off. Because the voltage generating unit 4 only has to generate fixed partial voltage values, the complexity of the driver circuit is reduced.

Figure 5:
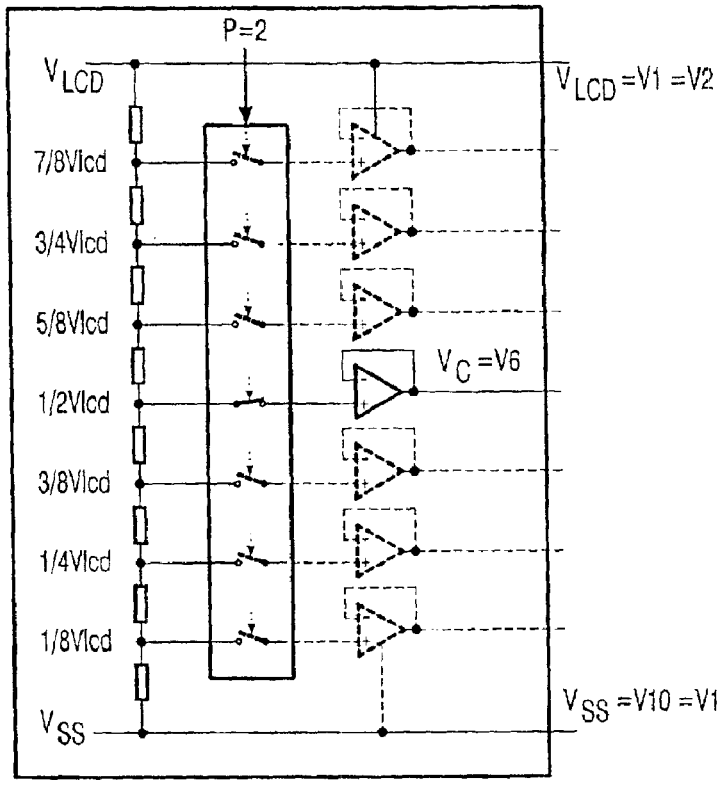
FIG. 5 shows the generating of partial voltages for p=2.

FIG. 5 shows the generating of partial voltage values for driving a display in which only two rows are driven simultaneously. In this case only three different voltage levels are required, two of these levels already being given by the two supply voltage levels $V_{LCD}$ and $V_{SS}$, so that merely $V_6$ must still be generated as a partial voltage value.

The adaptive selection of the simultaneously driven rows enables the best optical performance to be chosen for every display size while at the same time the power consumption is reduced. At the same time switching over to a partial display mode with an accompanying reduction of the power consumption is also possible. Furthermore, the driver circuit can be used for many different display sizes; the requirements imposed on the multiplexibility of the LCD liquid can then also be reduced.

For the adaptive selection of the simultaneously driven rows it is also necessary to take into account the fact that different sets of orthogonal functions are used for different values of p.

In order to avoid an increase of the complexity of the driver circuit due to a changing memory access for different p values, it is necessary to conceive the memory access sequence so as to be independent for all values p. The function generator offers different sets of orthogonal functions for different values p for supply to the switches 7 and 8. For the case p=8, eight orthogonal functions are combined with the eight data bits that are read from the RAM 9. p data bits that define the state of the driven pixels of the simultaneously driven rows are then read out by way of a single access for each column.

When the value p is reduced to four rows to be simultaneously driven, only five partial voltage values will be required, so that four voltage drivers are switched off and the entire system is scaled down so that the LCD supply voltage is reduced.

Figure 6:
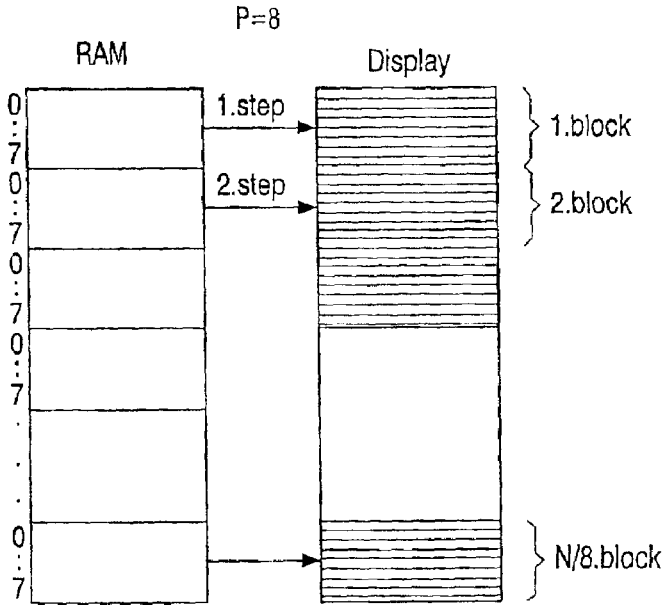
FIG. 6 shows a reading sequence for p=8.

The driving sequence for the rows remains the same for all feasible numbers p of rows to be simultaneously driven. Notably the memory access remains the same. The driving sequence for the rows is conceived for the maximum feasible number p and on the basis of this value p the sequences are derived for the lower values p. For p=8, therefore, for each column the data of eight rows is read from the memory; this data is combined with the eight orthogonal functions and the column is driven accordingly. At the same time the associated eight rows are selected and driven (FIG. 6). When p=4 (FIG. 7), the same eight data bits are read as in the case p=8. The selection of the rows, however, is subdivided into two sub-steps. In a first step the first four rows of the maximum number of eight rows that can be driven simultaneously are driven and in a second step the other four rows are driven; no memory access is required for the latter. For p=2 (FIG. 8), the driving of the eight rows is subdivided even further into steps of four times two rows. The eight data bits are again read from the memory 9 in one operation. This offers the advantage that the memory access remains the same. The addressing of the memory 9 is thus rendered independent of the selection of p.

Figure 7:
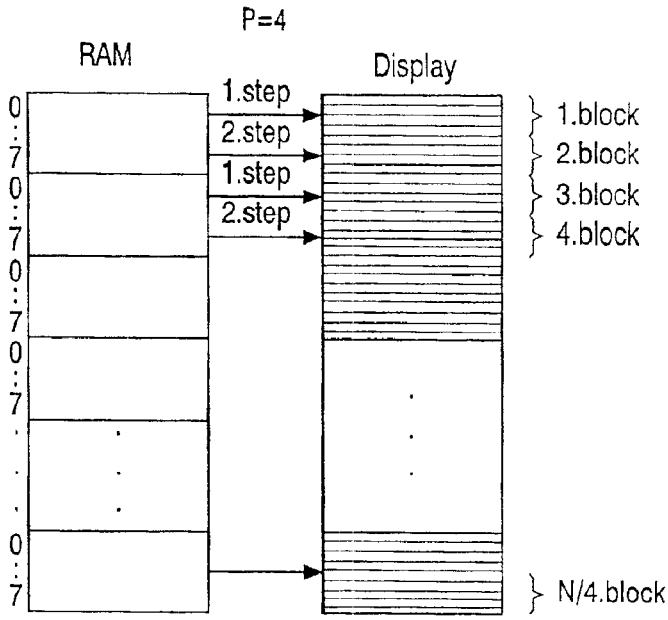
FIG. 7 shows a reading sequence for p=4.
Figure 8:
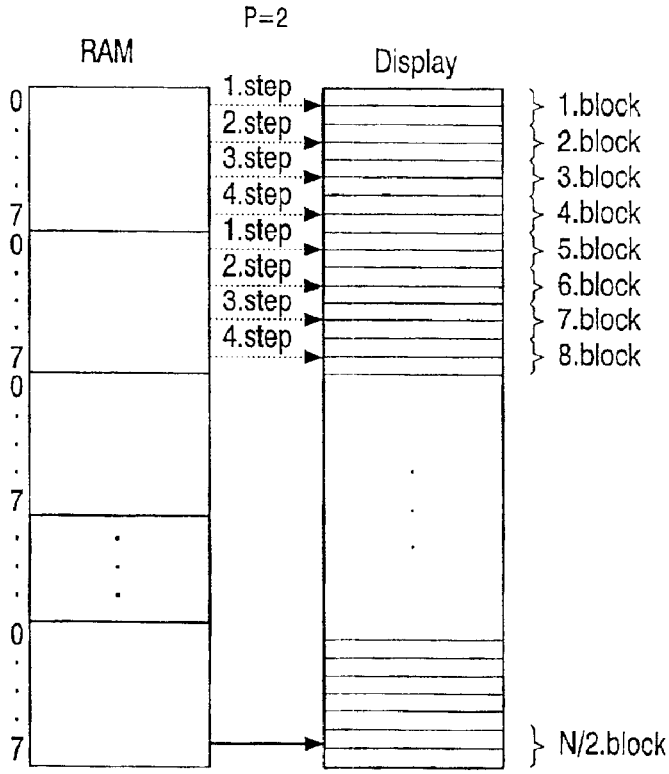
FIG. 8 shows a reading sequence for p=2.

The sequence of the driving of the rows, however, is not always as simple as shown in the FIGS. 6 to 8 where the first row of the first block is also the first row on the display, which display is written from the top down. The sequence may also be much more complex. The described mechanism for deriving the driving in the case of a number p that is smaller than the maximum number enables simple adaptation to the various functionalities of contemporary applications such as scrolling, mirroring or the compatibility of Tape Carrier Package TCP versus chip-on-glass applications. Relevant logic circuitry can thus be saved and the system can be more readily adapted to suit different display chips.

What is claimed is:

1. A display device which includes a driver circuit, an image data memory coupled to the display, and a display, with a plurality of rows R and columns C, coupled to the driver circuit, where a number $p_{max}$ indicates a maximum number of rows that can be simultaneously driven in the display device, where a number p indicates the number of rows selected to be simultaneously driven, where the rows R and the columns C can be driven by means of voltage values of the equally high voltages F and $G_{MAX}$, and where the display has a multiplexibility of m R, wherein the display device derives the number p from the display size to be driven, and is configured to adaptively select the number p in response to a change in a display mode that controls the display size to be driven, wherein the driver circuit includes a plurality of voltage driver stages for generating corresponding partial voltage values for driving the display, and is configured to selectively switch off driver voltage stages in response to a change in the selected number p such that the number of partial voltage values that are available for driving the display during the display mode varies in dependence on the number p selected for the display mode, and wherein the display device is operable such that a number of image data bits accessed from the image memory, is equal to $p_{max}$ regardless of the value of p.

2. The display device as claimed in claim 1, characterized in that the number p is derived from the display size to be driven during a partial display mode or from a sub-region of the display.

3. The display device as claimed in claim 1, characterized in that a sequence for the supply of the image data to be displayed from a memory is the same for all values p.

4. The display device as claimed in claim 1, characterized in that the simultaneously driven rows p can be subdivided into $p_{max}/p$ sub-regions for an optimum value p that is smaller than the maximum value of $p_{max}$.

5. The display device of claim 1, wherein $p_{max}$ equals 8 and p is selected from the values consisting of 2, 4, and 8.

6. The display device of claim 1, wherein when p is less than $p_{max}$ there are $p_{max}/p$ groups of simultaneously driven rows, and one access of the image memory to provide image data for the $p_{max}/p$ groups of simultaneously driven rows.

* * * * *